US012123658B2

(12) United States Patent
Aul et al.

(10) Patent No.: US 12,123,658 B2
(45) Date of Patent: Oct. 22, 2024

(54) HEAT EXCHANGER FOR THE THERMAL COUPLING OF TWO FLUIDS

(71) Applicant: MAHLE International GmbH, Stuttgart (DE)

(72) Inventors: Dennis Aul, Stuttgart (DE); Uwe Foerster, Erdmannhausen (DE); Martin Sievers, Kernen Im Remstel (DE); Dawid Trawinski, Ostrow Weilkopolski (PL)

(73) Assignee: Mahle International GmbH (DE)

( * ) Notice: Subject to any disclaimer, the term of this patent is extended or adjusted under 35 U.S.C. 154(b) by 0 days.

(21) Appl. No.: 17/968,760

(22) Filed: Oct. 18, 2022

(65) Prior Publication Data

US 2023/0124890 A1 Apr. 20, 2023

(30) Foreign Application Priority Data

Oct. 19, 2021 (DE) ..... 10 2021 211 777.5

(51) Int. Cl.
*F28D 7/16* (2006.01)

(52) U.S. Cl.
CPC ..... *F28D 7/16* (2013.01)

(58) Field of Classification Search
CPC ..... F28D 7/16; F28F 9/0202; F28F 9/0204; F28F 9/0207; F28F 9/0209; F28F 9/0219
USPC ..... 165/175
See application file for complete search history.

(56) References Cited

U.S. PATENT DOCUMENTS 5,842,515 A * 12/1998 Kim ..... F28F 9/182 165/173
7,073,571 B2 * 7/2006 Yu ..... F28F 9/0212 165/175
2009/0229800 A1 * 9/2009 Bhatti ..... F28D 1/0426 165/165
2011/0220318 A1 * 9/2011 Kopchick ..... F28F 9/0212 165/41
2014/0202673 A1 * 7/2014 Wand ..... F28D 1/05383 165/175

(Continued)

FOREIGN PATENT DOCUMENTS

CN 112013710 A 12/2020
EP 3301394 A1 4/2018
EP 3916331 A1 12/2021

OTHER PUBLICATIONS

English abstract for CN-1 12 013 710.

*Primary Examiner* — Raheena R Malik
(74) *Attorney, Agent, or Firm* — Fishman Stewart PLLC

(57) ABSTRACT

A heat exchanger for the thermal coupling of two fluids may include an inflow pipe defining a pipe longitudinal centre axis. A fluid inlet may be arranged on the inflow pipe. A plurality of flat tubes leading into the inflow pipe may be arranged on the inflow pipe adjacent to the fluid inlet. The first fluid stream may be flowable along a first fluid path extending from the fluid inlet through the inflow pipe and the plurality of flat tubes. The flat tubes may extend through a second fluid path for a second fluid stream of fluid and may be flowed about by the second fluid stream during operation. The heat exchanger may further include passage screen aperture interacting with the heat exchanger fluid and through which the first fluid stream is flowable. The passage screen aperture may be fluidically connected in series with the flat tubes.

20 Claims, 3 Drawing Sheets

(56) References Cited

U.S. PATENT DOCUMENTS

| | | | | |
|---|---|---|---|---|
| 2023/0108901 | A1* | 4/2023 | Nakata | F28F 9/0278 165/175 |
| 2023/0111700 | A1* | 4/2023 | Jiang | F28F 9/0243 165/175 |
| 2023/0124890 | A1* | 4/2023 | Aul | F28D 7/16 165/175 |
| 2023/0280112 | A1* | 9/2023 | Komuro | F28D 1/05366 165/175 |
| 2023/0288145 | A1* | 9/2023 | Maema | F28D 7/16 165/175 |
| 2023/0332836 | A1* | 10/2023 | Duerr | F25B 39/02 |

* cited by examiner

HEAT EXCHANGER FOR THE THERMAL COUPLING OF TWO FLUIDS

CROSS-REFERENCE TO RELATED APPLICATIONS

This application claims priority to German Patent Application No. DE 10 2021 211 777.5, filed on Oct. 19, 2021, the contents of which is hereby incorporated by reference in its entirety.

TECHNICAL FIELD

The invention relates to a heat exchanger for the thermal coupling of two fluids.

BACKGROUND

Heat exchangers of this type are known. They are employed in particular in automotive engineering for the thermal coupling of two fluids so that heat energy can be exchanged between a first fluid and a second fluid. However, popular heat exchangers frequently exhibit a phenomenon called "cold spot", which describes a highly inhomogeneous temperature distribution across the heat exchanger. As a consequence of the inhomogeneous temperature distribution, the efficiency of the heat exchanger decreases, which is undesirable.

SUMMARY

The object of the invention therefore lies in stating an improved or at least another embodiment of a heat exchanger.

In the present invention, this object is solved in particular through the subject matter of the independent claim(s). Advantageous embodiments are the subject matter of the dependent claim(s).

The basic idea of the invention lies in improving the internal distribution of a heat exchanger fluid flowing through a heat exchanger, which is formed in particular by a two-phase refrigerant-oil mixture, over flat tubes of the heat exchanger.

For this purpose, the invention proposes a heat exchanger for the thermal coupling of two fluids which is equipped with an inflow pipe defining a pipe longitudinal centre axis and practically with an outflow pipe. On the inflow pipe, a fluid inlet for the inflow of a first fluid stream of heat exchanger fluid which is formed in particular by a two-phase refrigerant-oil mixture, and multiple flat tubes adjacent to the fluid inlet in the direction of the pipe longitudinal centre axis are arranged on the shell side, i.e. in particular on a longitudinal lower shell or on a longitudinal lower shell still described in the following. Along the pipe longitudinal centre axis, the flat tubes are spaced apart from one another. Furthermore, the flat tubes each lead into the inflow pipe so that the first fluid stream can flow along a first fluid path extending from the fluid inlet through the inflow pipe, through the flat tubes and further downstream if applicable through the outflow pipe. Away from the inflow pipe and from the outflow pipe, the flat tubes extend through a second fluid path for a second fluid stream of fluid, in particular air, so that the flat tubes can be flowed through by the first fluid stream and flowed about by the second fluid stream. In particular, a heat stream at this point can be exchanged between the two fluid streams, wherein the first fluid stream functions as heat sink and the second fluid stream as heat source, or vice versa. The heat exchanger according to the invention furthermore comprises a passage screen aperture that can be flowed through by the first fluid stream and interacts with the heat exchanger fluid, which passage screen aperture is fluidically connected in series with the flat tubes. The passage screen aperture interacts with the heat exchanger fluid so that when the heat exchanger fluid flows into the inflow pipe, swirl flows in the heat exchanger fluid generated in the region of the fluid inlet, which in practice are referred to as swirl flows, are dissolved or at least reduced. This has the effect that an optimal distribution of the first fluid stream over the flat tubes can be adjusted. This has the advantage that practically each flat tube is supplied with the same fluid volume flow or fluid mass flow of liquid phase and gas phase, as a result of which a relatively homogeneous temperature distribution can be achieved on the heat exchanger.

Practically it can be provided that the passage screen aperture is arranged upstream of the flat tubes with respect to the first fluid stream. At the same time, it can be provided downstream that the passage screen aperture is connected downstream of the fluid inlet with respect to the first fluid stream. By way of this, preferred positions for the passage screen aperture in the first fluid path are stated. The passage screen aperture positioned in such a position can realise an optimal reduction of the swirl flows in the heat exchanger fluid. Advantageously, the passage screen aperture can be positioned within the inflow pipe.

Furthermore, it can be provided that the passage screen aperture is arranged on a passage screen, which in the first fluid path is arranged between the fluid inlet and the flat tubes. In addition it has been recognised within the scope of tests that an arrangement of the passage screen between the fluid inlet and an immediately adjacent first flat tubes of the flat tubes located next to the said fluid inlet in the direction of the pipe longitudinal centre axis can be advantageous because an optimal reduction of the swirl flows in the heat exchanger fluid can thereby be realised and an excellent distribution of the existing gas and liquid phases of the first fluid stream over the flat tubes can be adjusted.

It is practical when between the passage screen aperture of the passage screen and a first flat tubes of the flat tubes located with respect to the fluid inlet next in the direction of the pipe longitudinal centre axis and directly adjacent a gap, to be measured parallel to the pipe longitudinal centre axis, is adjusted, which lies in a range between 2.0 mm to 9.0 mm, or preferably in a range between 3.0 mm and 6.0 mm. A passage screen arranged accordingly having a passage screen aperture can realise a preferred reduction of the swirl flows in the heat exchanger fluid.

It is practical, further, when the passage screen aperture is arranged on a passage screen which comprises a surrounding outer edge at least in portions, via which the passage screen supports itself at least in portions in a touching and optionally fluid-tight manner on at least one pipe inner circumferential surface of the inflow pipe. By way of this, the passage screen can be fixed if applicable in a fluid-tight manner on at least one pipe inner circumferential surface within the inflow pipe. Here, the passage screen can be practically fixed on the inflow pipe in the region of the outer edge, for example, by soldering or welding or alternatively or additionally by a positively and/or non-positively fixed connection.

It is practical, furthermore, when the outer edge comprises or forms a stiffening, reinforcing the passage screen against shape change in that it is embodied with a thickness in a range between 1.4 mm to 3.0 mm. This has the advantage that the passage screen can be produced so as to be relatively stiff in order to be relatively resistant to mechanical deformation. This generates the advantage that the passage screen during the manufacture of a heat exchanger can be provided in large quantities and as bulk material. This facilitates the manufacture of a heat exchanger.

It is practical, furthermore, when the passage screen aperture is arranged on a passage screen which comprises at least one insert tab projecting with respect to an passage screen centre of the passage screen projects radially to the outside, which for the positively and/or non-positively fixing of the passage screen on the inflow pipe is inserted into a tab groove arranged on the inflow pipe and formed complementarily with respect to the at least one insert tab. Practically, exactly two separate insert tabs or even more separate insert tabs can be provided on the passage screen, which each engage into their own tab groove arranged on the inflow pipe. By this constructive measure, the passage screen can be relatively easily arranged on the inflow pipe.

In this connection it can also be provided that between each two insert tabs projecting away with respect to the passage screen centre radially to the outside an acute angle is defined, preferably an angle in the range of smaller than 90°.

It can also be practical when at least one insert tab has two tab sides oriented opposite to one another and aligned parallel to one another and a tab front side connecting these two tab sides with one another. Here, the insert tabs can be embodied so that the tab sides, when the passage screen is mounted on the inflow pipe, lies against the inflow pipe touchingly and if applicable with a slide oversize fit. The tab front side can practically be arranged with respect to the passage screen centre of the passage screen on the inflow pipe radially without contact and if applicable form a protrusion radially protruding over the same.

Practically, the inflow pipe is embodied in two parts for the purpose of which it is divided along the pipe longitudinal centre axis into a longitudinal lower shell and a longitudinal upper shell, wherein the said outer edge of the passage screen is split into a first surrounding receiving portion for receiving the longitudinal lower shell and a second surrounding receiving portion, recessed with respect to the first receiving portion, for receiving the longitudinal upper shell. A corresponding inflow pipe, in particular a round pipe can be produced cost-effectively. The longitudinal lower shell, which in particular has a U-shape or C-shape and the longitudinal upper shell which likewise has in particular a U-shape or C-shape, can be relatively easily arranged on the passage screen with the help of the said first and second receiving portion. Here, the term "recessed" practically relates to the said passage screen centre of the passage screen, so that the first receiving portion thus describes a greater gap with respect to the passage screen centre than the second receiving portion. The first and second receiving portion can be configured complementarily to the longitudinal lower shell and to the longitudinal upper shell respectively. In this connection it can be advantageous when the passage screen has a substantially circular or a circular surface area.

It is practical further, when the passage screen aperture is arranged on a passage screen which comprises or forms at least one flow separation edge framing the passage screen aperture at least in portions. Furthermore, swirl flows in the heat exchanger fluid can be relatively favourably reduced in that the passage screen aperture defines a circular segment-shaped opening contour.

Swirl flows in the heat exchanger fluid can still be reduced relatively well in that the passage screen aperture defines a circular segment-shaped opening contour.

Furthermore, the passage screen aperture can be arranged on a passage screen defining a screen centre, wherein a plane runs through the screen centre, which plane runs parallel with respect to the pipe longitudinal centre axis and is oriented orthogonally with respect to flat tube centre axes, which are defined by the flat tubes, so that the plane divides the passage screen into a first side facing away from the flat tubes and a second side facing the flat tubes. The passage screen aperture is preferably arranged on the first side of the passage screen facing away from the flat tubes. By way of this, a preferred position of the passage screen aperture on the passage screen is stated.

It is practical, furthermore, when the passage screen aperture is arranged on a passage screen which defines an in particular flat surface area, wherein the passage area of the passage screen aperture is minimally 5% of the surface area. Alternatively or additionally, the passage area of the passage screen aperture can amount to maximally 50% of the surface area or more. It is practical when the passage area of the passage screen aperture amounts to minimally 5% and maximally 25% of the surface area. It is also conceivable that the passage area of the passage screen aperture amounts to 25% to 50% or 25% to 75%, or 25% or 50% or 75% of the surface area. Because of this, a preferred advantageous ratio between the passage screen aperture that can be flowed through and the surface area of the passage screen is stated.

In summary it remains to note: the present invention preferentially relates to a heat exchanger which comprises an inflow pipe defining a pipe longitudinal centre axis on which a fluid inlet for the inflow of a first fluid stream and in the direction of the pipe longitudinal centre axis adjacent to the fluid inlet flat tubes are arranged, which along the pipe longitudinal centre axis are spaced apart from one another and lead into the inflow pipe so that the first fluid stream can flow along a first fluid path extending from the fluid inlet through the flat tubes. The flat tubes extend away from the inflow pipe through a second fluid path for a second fluid stream, as a result of which the flat tubes can be flowed through by the first fluid stream and flowed about by the second fluid stream. Furthermore, the heat exchanger comprises a passage screen aperture that can be flowed through by the first fluid stream and interacts with the heat exchanger fluid, which is fluidically connected in series with the flat tubes.

Further important features and advantages of the invention are obtained from the subclaims, from the drawings and from the associated figure description by way of the drawings.

It is to be understood that the features mentioned above and still to be explained in the following cannot only be used in the respective combination stated but also in other combinations or by themselves without leaving the scope of the present invention.

Preferred exemplary embodiments of the invention are shown in the drawings and are explained in more detail in the following description, wherein same reference numbers relate to same or similar or functionally same components.

BRIEF DESCRIPTION OF THE DRAWINGS

It shows, in each case schematically

DETAILED DESCRIPTION

FIGS. 1 to 6 show preferred exemplary embodiments for a heat exchanger designated as a whole with the reference number 1, which serves for the thermal coupling of two fluids. Such heat exchangers 1 can be preferably employed in motor vehicle applications, but they can also be applied in the private sphere.

Figure 1:
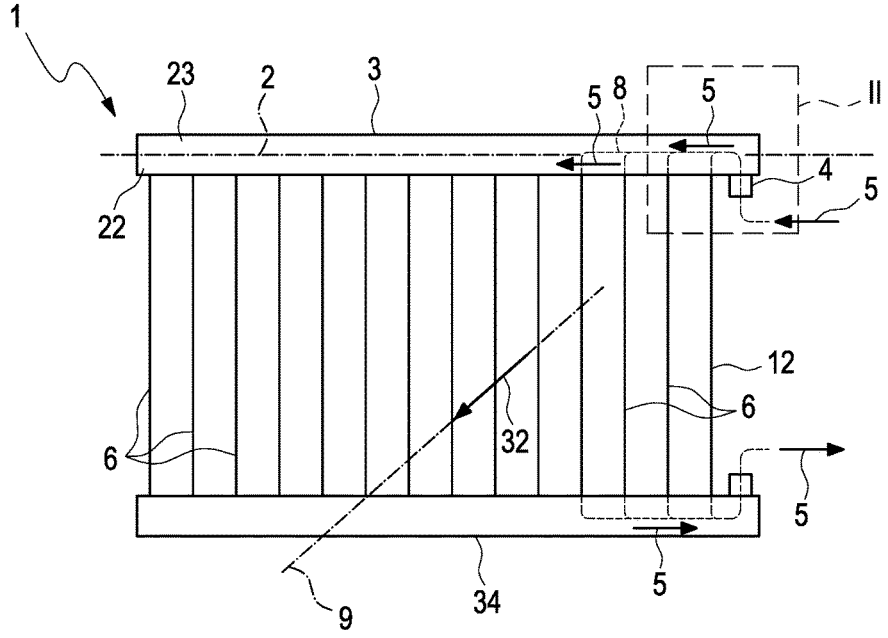
FIG. 1 shows a lateral view of a preferred exemplary embodiment of a heat exchanger.

FIG. 1 shows a preferred highly simplified heat exchanger 1 not to scale according to a first exemplary embodiment in a lateral view, so that an inflow pipe 3 arranged on the head side and an outflow pipe 34 arranged on the foot side is noticeable, which are fluidically connected to one another by way of multiple flat tubes 6, 12 each symbolized by a line. The inflow pipe 3 defines in its main extension direction a pipe longitudinal centre axis 2 and is purely exemplarily embodied in two parts, so that it comprises a longitudinal lower shell 22 and a longitudinal upper shell 23. On the longitudinal lower shell 22 of the inflow pipe 3 a fluid inlet 4 realised by a cylinder sleeve is arranged, which is utilised for the inflow of a first fluid stream 5 of heat exchanger fluid. In FIG. 1 it is noticeable, furthermore, that the fluid inlet 4 is followed by multiple flat tubes 6, 12 which are adjacent to the fluid inlet in the direction of the pipe longitudinal centre axis 2, which are spaced apart from one another along the pipe longitudinal centre axis 2. The flat tubes 6, 12 are arranged on the inflow pipe 3 or its longitudinal lower shell 22 so that they lead into the inflow pipe 3 each. By way of this, the first fluid stream 5 can flow along a first fluid path 8 extending from the fluid inlet 4 through the inflow pipe 3, the flat tubes 6, 12 and the outflow pipe 34, which fluid path 8 is indicated in FIG. 1 by a dashed line.

Away from the inflow pipe 3 and from the outflow pipe 34, the said flat tubes 6, 12 extend through a second fluid path 9 for a second fluid stream 32 of cooling fluid, so that the flat tubes 6, 12 can be flowed through by the first fluid stream 5 and flowed about by the second fluid stream 32. This means that the two fluid streams 5, 32 intersect. By way of this, a heat energy stream can be exchanged between the two fluid streams 5, 32. Practically, the first fluid stream 5 functions as heat source and the second fluid stream 32 as heat sink or vice versa.

Figure 2:
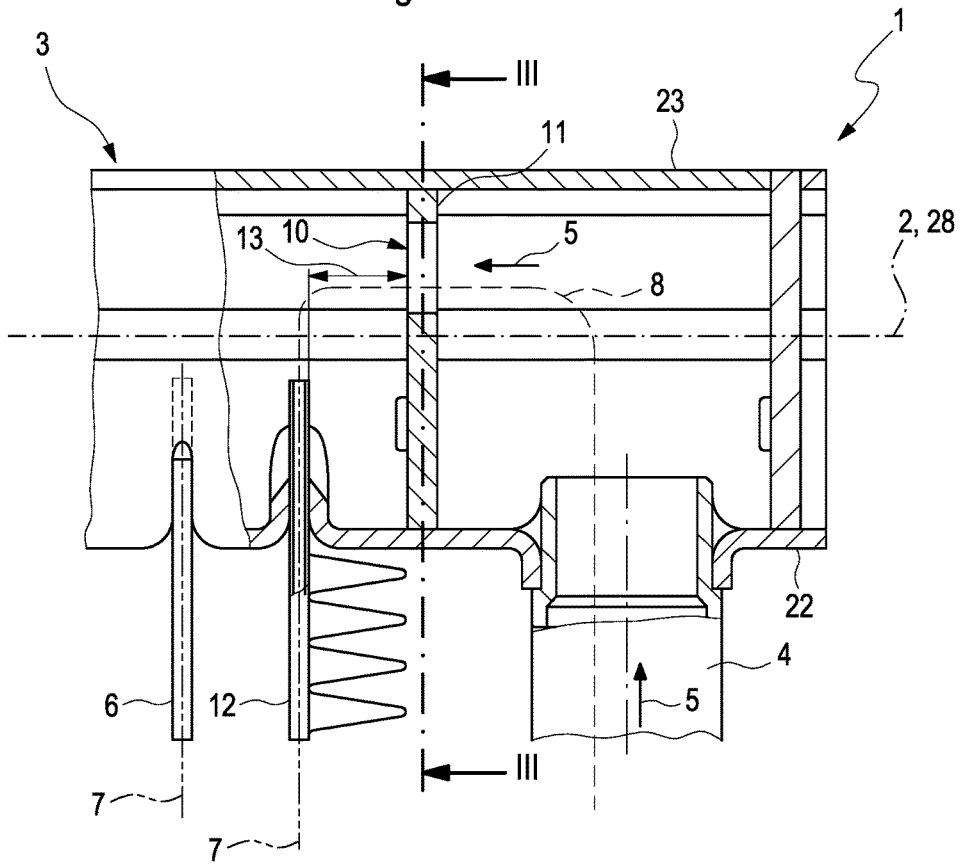
FIG. 2 shows a part sectional view of an extract of the heat exchanger from FIG. 1 enclosed in FIG. 1 with a dashed frame.

With respect to FIG. 2 it should be noted that the heat exchanger 1 is equipped with a passage screen 11 which comprises a contiguous passage screen aperture 10 which is fluidically connected in series with the flat tubes 6, 12 and through which the first fluid path 8 extends, so that the first fluid stream 5 can flow through the same. The passage screen aperture 10 interacts with the first fluid stream 5 or the heat exchanger fluid so that swirl flows in the heat exchanger fluid generated in the region of the fluid inlet 4 when the heat exchanger fluid flows into the inflow pipe 3 can be dissolved or at least reduced. This has the effect that an optimal distribution of the first fluid stream 5 over the mouth openings of the flat tubes 6, 12 can be adjusted. Furthermore, the passage screen aperture 10 exemplarily delimits a passage area which is not additionally designated in the figures.

The said passage screen 11 or the passage screen aperture 10 is arranged in the first fluid path 8 between the fluid inlet 4 and a first flat tube 12 of these flat tubes 6, 12 which with respect to the fluid inlet 4 is located next in the direction of the pipe longitudinal centre axis 2 and directly adjacent. Purely exemplarily, a gap 13 to be measured parallel to the pipe longitudinal centre axis 2 is adjusted between the passage screen 11 or the passage screen aperture 10 and the first flat tube 12. This gap can lie within a range between 2.0 mm to 9.0 mm or preferably within a range between 3.0 mm and 6.0 mm.

Figure 3:
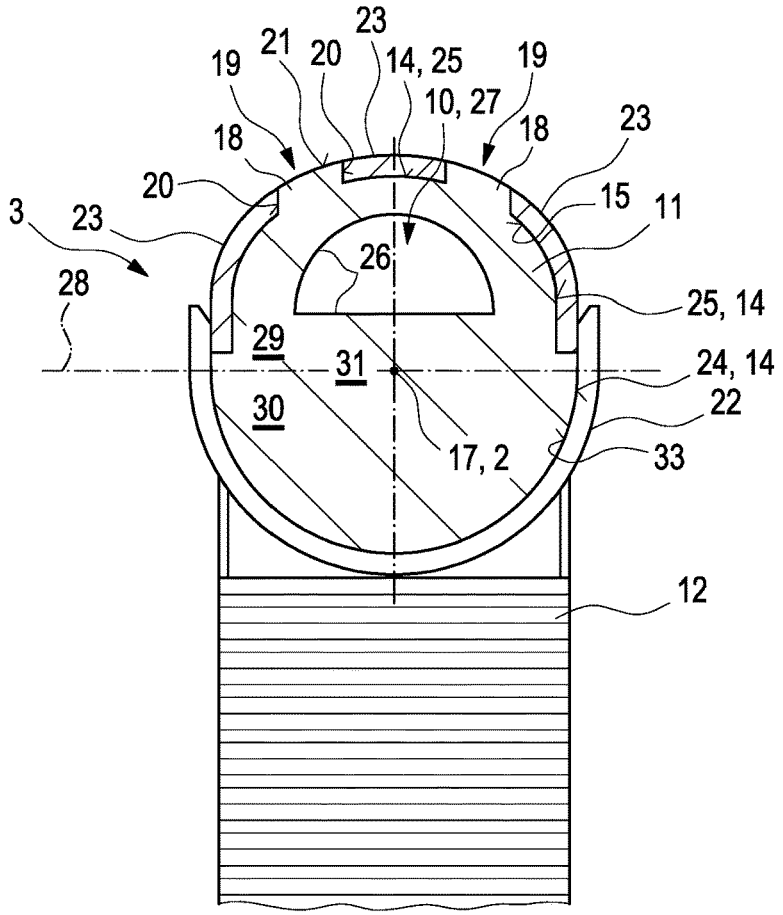
FIG. 3 shows a further part sectional view of the heat exchanger from FIG. 1 with view in the direction of arrows III entered in FIG. 2, wherein the heat exchanger is split according to a section plane III-III drawn in in FIG. 2.

With respect to FIG. 3 it should be noted initially that the passage screen aperture 10 delimits or forms a circular segment-shaped opening contour 27. Furthermore, the passage screen 11 has a surrounding outer edge 14, which is divided into a first surrounding receiving portion 24 and a second surrounding receiving portion 25 recessed with respect to the first receiving portion 24. In the assembled state of the heat exchanger 1 it is provided that the longitudinal upper shell 23 with its pipe inner circumferential surface 15 oriented radially to the inside supports itself on the second receiving portion 25 and the longitudinal lower shell 22 with its pipe inner circumferential surface 33 likewise oriented radially to the inside on the first receiving portion 24 in a fluid-tight manner. Here, the passage screen 11 can at least basically be fixed in places either to the longitudinal lower shell 22 and/or the longitudinal upper shell 23 by for example soldering or welding or alternatively by way of a positively and/or non-positively fixed connection.

Figure 4:
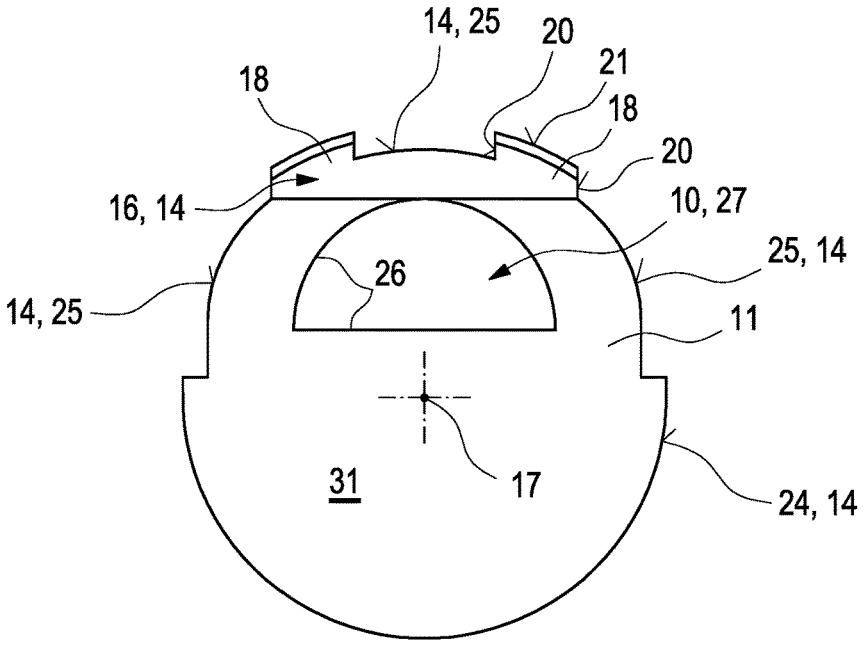
FIG. 4 shows, in a front view, a passage screen with passage screen aperture of a heat exchanger according to a further exemplary embodiment and the FIGS. 5 and 6 each show, in a front view, a passage screen with passage screen aperture of a heat exchanger according to a further exemplary embodiment.

In FIG. 4 it is indicated that the outer edge 14 comprises or forms a stiffening 16 reinforcing the passage screen 11 against a shape change. For this purpose, the outer edge 14 according to the exemplary embodiment in FIG. 4 is at least partially embodied with a thickness within a range between 1.4 mm to 3.0 mm.

In FIGS. 3 and 4 it is noticeable, furthermore, that the passage screen 11 defines a geometrical screen centre and comprises two separate insert tabs 18 which with respect to the screen centre 17 project radially to the outside. The insert tabs 18 serve for positively and/or non-positively mounting and/or fixing the passage screen 11 on the inlet pipe 3. The inflow pipe 3 is equipped with two tab grooves 19 for this purpose, which here are arranged on the longitudinal upper shell 23 complementarily with respect to the two insert tabs 18, into which tab grooves 19 an insert tab 18 each can be inserted. In FIG. 3 it is noticeable that the insert tabs 18, when these are inserted into the respective tab grooves 19 of the longitudinal upper shell 23, bring about an at least positive mounting of the passage screen 11 on the inflow pipe 3. Here, two tab sides 20 oriented opposite to one another and aligned parallel with one another and a tab front side 21 of a respective insert tab 18 connecting these two tab sides 20 with one another, practically lie touchingly and if applicable with a slight oversize fit against the tab grooves 19 of the longitudinal upper shell 23.

Both in FIG. 3 and also in FIG. 4 it is noticeable that the passage screen aperture 10 is framed by a flow separation edge 26 formed by the passage screen 11. The flow separation edge 26 exemplarily interacts fluidically with the first fluid stream 5 flowing through the passage screen aperture 10 so that a liquid phase of the heat exchanger fluid carried along in the first fluid stream 5 is distributed in the gas phase of the heat exchanger fluid and evenly distributed over the fluid tubes 6, 12 in the fluid stream 5 downstream of the passage screen 11.

With respect to FIGS. 2 and 3 it must be explained that a plane 28, which in each case is indicated with a dash-dotted line only in the form of an extract, is provided, which exemplarily runs through the said screen centre 17. In addition to this, the plane 28 is aligned parallel with respect to the pipe longitudinal centre axis 2 and orthogonally with respect to flat tube centre axes 7, which are indicated in FIG. 2 by double-dotted lines and defined by the flat tubes 6, 12. By way of this, the plane 28 divides the passage screen 11 into a first side 29 facing away from the flat tubes and a second side 30 facing the flat tubes, see in particular FIG. 3. In order to realise an optimal distribution of the first fluid stream 5 over the flat tubes 6, 12 it is provided that the passage screen aperture 10 is arranged on the first side 29 of the passage screen 11 facing away from the flat tubes. Here it can be practical when the passage area of the passage screen aperture 10 amounts to between minimally 5% and maximally 50% of a surface area 31 of the passage screen 11.

Figure 5:
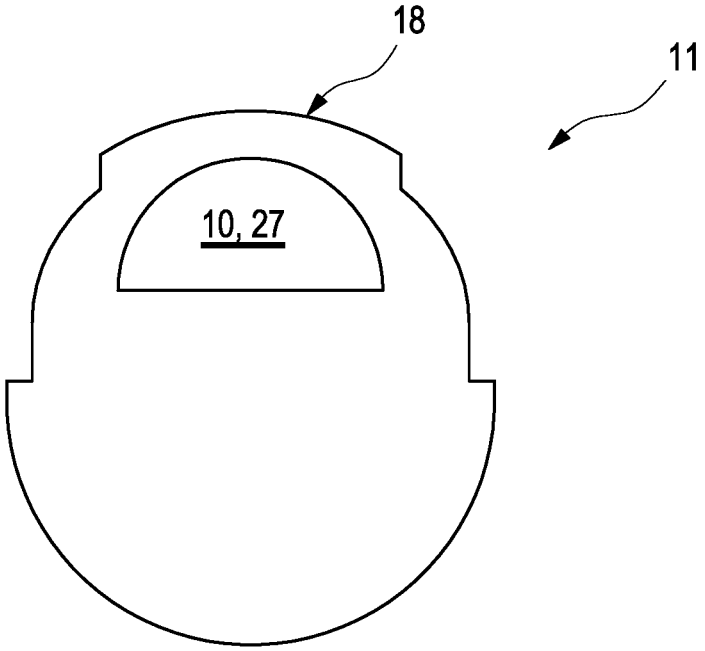
Figure 6:
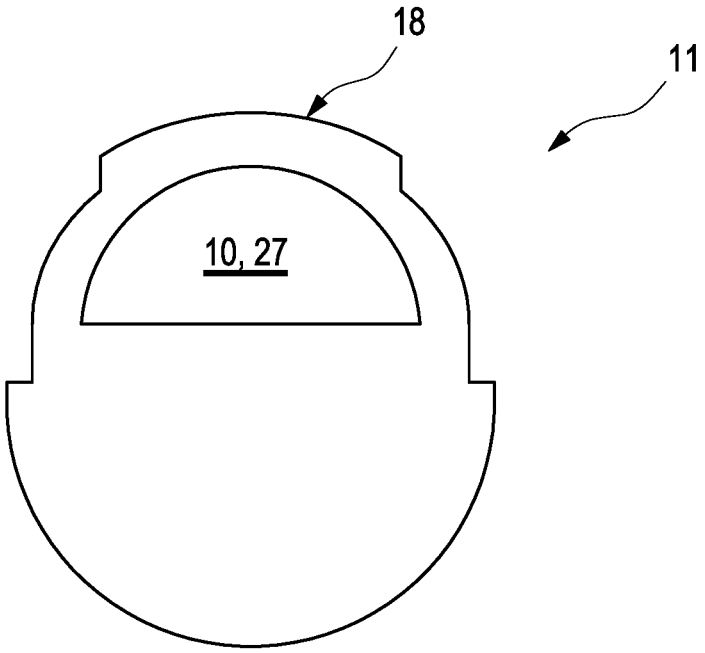

FIGS. 5 and 6 each show in a front view a passage screen 11 with a passage screen aperture 10 of a heat exchanger 1 according to further exemplary embodiments. Passage screen 11 according to FIG. 5 differs from the passage screen 11 from FIGS. 1 to 4 in that now merely a single insert tab 18 is provided. The passage screen 11 according to FIG. 6 differs from the passage screen 11 from FIG. 5 in that the passage area of the passage screen aperture 10 is slightly enlarged in terms of area.

The invention claimed is:

1. A heat exchanger for the thermal coupling of two fluids, comprising:

an inflow pipe defining a pipe longitudinal centre axis;

a fluid inlet arranged on the inflow pipe via which a first fluid stream of heat exchanger fluid is flowable into the inflow pipe;

a plurality of flat tubes arranged on the inflow pipe adjacent to the fluid inlet in a direction of the pipe longitudinal centre axis, the plurality of flat pipes disposed spaced apart from one another along the pipe longitudinal centre axis and each leading into the inflow pipe such that the first fluid stream is flowable along a first fluid path extending from the fluid inlet through the inflow pipe and the plurality of flat tubes;

the plurality of flat tubes extending through a second fluid path for a second fluid stream of fluid such that the plurality of flat tubes are flowed through by the first fluid stream and flowed about by the second fluid stream during operation;

a passage screen arranged in the first fluid path between the fluid inlet and the plurality of flat tubes;

the passage screen including a passage screen aperture interacting with the heat exchanger fluid and through which the first fluid stream is flowable;

wherein the passage screen aperture is fluidically connected in series with the plurality of flat tubes; and wherein a gap between the passage screen aperture of the passage screen and a first flat tube of the plurality of flat tubes, which with respect to the fluid inlet is disposed next in the direction of the pipe longitudinal centre axis and directly adjacent to the passage screen, has a length measured parallel to the pipe longitudinal centre axis of 2.0 mm to 9.0 mm.

2. The heat exchanger according to claim 1, wherein the passage screen has a surrounding outer edge via which the passage screen supports itself, at least in portions touchingly, on at least one pipe inner circumferential surface of the inflow pipe.

3. The heat exchanger according to claim 2, wherein:

the outer edge has a thickness of 1.4 mm to 3.0 mm; and the outer edge at least one of includes and forms a stiffening reinforcing the passage screen against a shape change.

4. The heat exchanger according to claim 1, wherein:

the passage screen further includes at least one insert tab projecting, with respect to a screen centre of the passage screen, radially to an outside;

the at least one insert tab is inserted into a tab groove of the inflow pipe at least one of positively and non-positively coupling the passage screen to the inflow pipe; and the tab groove is formed complementarily to the at least one insert tab.

5. The heat exchanger according to claim 2, wherein:

the inflow pipe is divided along the pipe longitudinal centre axis into a longitudinal lower shell and a longitudinal upper shell; and the outer edge of the passage screen is split into a first circumferential receiving portion for receiving the longitudinal lower shell and a second circumferential receiving portion, which is recessed with respect to the first receiving portion, for receiving the longitudinal upper shell.

6. The heat exchanger according to claim 1, wherein the passage screen at least one of includes and forms at least one flow separation edge framing the passage screen aperture at least in portions.

7. The heat exchanger according to claim 1, wherein the passage screen aperture defines a circular segment-shaped opening contour.

8. The heat exchanger according to claim 1, wherein:

the passage screen defines a screen centre;

a plane extends through the screen centre;

the plane extends parallel to the pipe longitudinal centre axis and is aligned orthogonally with respect to a plurality of flat tube centre axes defined by the plurality of flat tubes such that the plane divides the passage screen into a first side facing away from the plurality of flat tubes and a second side facing the plurality of flat tubes; and the passage screen aperture is arranged on the first side of the passage screen.

9. The heat exchanger according to claim 1, wherein:

the passage screen defines a surface area; and a passage area of the passage screen aperture amounts to 5% or more of the surface area.

10. The heat exchanger according to claim 1, wherein:

the passage screen includes at least one flow separation edge framing the passage screen aperture; and the at least one flow separation edge interacts fluidically with the first fluid stream flowing through the passage screen aperture such that, downstream of the passage screen, a liquid phase of the heat exchanger fluid in the first fluid stream is distributed in a gas phase of the heat exchanger fluid and evenly distributed over the plurality of fluid tubes.

11. The heat exchanger according to claim 1, wherein:

the inflow pipe is defined by a longitudinal upper shell and a longitudinal lower shell that are connected to one another;

the passage screen has a surrounding outer edge including:

a first contour portion engaging an inner surface of the lower shell;

a second contour portion engaging an inner surface of the upper shell; and two step portions connecting the first contour portion and the second contour portion; and two opposing ends of the upper shell project into the lower shell, contact the inner surface of the lower shell, and abut a respective step portion of the two step portions of the outer edge of the passage screen.

12. The heat exchanger according to claim 11, wherein:

the passage screen further includes a first insert tab and a second insert tab projecting outward from the second contour portion of the outer edge;

the first insert tab is received in a first tab groove of the upper shell and the second insert tab is received in a second tab groove of the upper shell; and the first insert tab and the second insert tab extend parallel to one another.

13. The heat exchanger according to claim 1, wherein:

the inflow pipe is defined by a longitudinal upper shell and a longitudinal lower shell that are connected to one another;

the passage screen has, in a cross-section perpendicular to the first fluid stream, an upper half disposed adjacent to the upper shell and a lower half disposed adjacent to the lower shell; and the passage screen aperture is disposed entirely within the upper half of the passage screen.

14. A heat exchanger for the thermal coupling of two fluids, comprising:

an inflow pipe having a pipe longitudinal centre axis;

the inflow pipe including (i) a fluid inlet via which a heat exchanger fluid is flowable into the inflow pipe, (ii) a first longitudinal shell, and (iii) a second longitudinal shell, the first shell and the second shell connected to one another and defining the inflow pipe;

a plurality of flat tubes arranged on the inflow pipe spaced apart from one another in a direction of the pipe longitudinal centre axis, the plurality of flat tubes each in fluid communication with the inflow pipe such that a first fluid stream of the heat exchanger fluid is flowable along a first fluid path extending from the fluid inlet, through the inflow pipe into the plurality of flat tubes, and through the plurality of flat tubes;

the plurality of flat tubes extending through a second fluid path of a fluid such that a second fluid stream of the fluid is flowable around an exterior of the plurality of flat tubes;

a passage screen arranged within the inflow pipe between the fluid inlet and the plurality of flat tubes relative to a flow direction of the first fluid flow;

wherein the passage screen includes a passage screen aperture interacting with the heat exchanger fluid and through which the first fluid stream is flowable;

wherein the passage screen has a surrounding outer edge, the outer edge including (i) a first contour portion engaging an inner surface of the first shell and (ii) a second contour portion engaging an inner surface of the second shell; and wherein the second contour portion of the outer edge of the passage screen is offset toward a centre of the passage screen relative to the first contour portion.

15. The heat exchanger according to claim 14, wherein a gap between the passage screen aperture of the passage screen and a first flat tube of the plurality of flat tubes, which with respect to the fluid inlet is disposed next in the direction of the pipe longitudinal centre axis and directly adjacent to the passage screen, has a length measured parallel to the pipe longitudinal centre axis of 2.0 mm to 9.0 mm.

16. The heat exchanger according to claim 14, wherein:

the outer edge of the passage screen further includes two step portions connecting the first contour portion and the second contour portion; and two opposing ends of the second shell project into the first shell, contact the inner surface of the first shell, and abut a respective step portion of the two step portions of the outer edge of the passage screen.

17. The heat exchanger according to claim 16, wherein:

the passage screen further includes a first insert tab and a second insert tab projecting outward from the second contour portion of the outer edge;

the first insert tab is received in a first tab groove of the second shell and the second insert tab is received in a second tab groove of the second shell; and the first insert tab and the second insert tab extend parallel to one another and are disposed spaced apart from the two step portions of the outer edge of the passage screen.

18. A heat exchanger for the thermal coupling of two fluids, comprising:

an inflow pipe having a pipe longitudinal centre axis;

the inflow pipe including a fluid inlet via which a heat exchanger fluid is flowable into the inflow pipe;

a plurality of flat tubes arranged on the inflow pipe spaced apart from one another in a direction of the pipe longitudinal centre axis, the plurality of flat tubes each in fluid communication with the inflow pipe such that a first fluid stream of the heat exchanger fluid is flowable along a first fluid path extending from the fluid inlet, through the inflow pipe into the plurality of flat tubes, and through the plurality of flat tubes;

the plurality of flat tubes extending through a second fluid path of a fluid such that a second fluid stream of the fluid is flowable around an exterior of the plurality of flat tubes;

a passage screen arranged within the inflow pipe between the fluid inlet and a flat tube of the plurality of flat tubes disposed closest to the fluid inlet;

the passage screen disposed downstream of the fluid inlet and upstream of the plurality of flat tubes relative to the first fluid flow;

wherein the passage screen includes a circular segment-shaped passage screen aperture through which the first fluid stream is flowable; and wherein the passage screen and the passage screen aperture are structured and arranged to interact with the first fluid stream such that swirl flows in the heat exchanger fluid are reduced.

19. The heat exchanger according to claim 18, wherein a gap between the passage screen aperture of the passage screen and a first flat tube of the plurality of flat tubes, which with respect to the fluid inlet is disposed next in the direction of the pipe longitudinal centre axis and directly adjacent to the passage screen, has a length measured parallel to the pipe longitudinal centre axis of 2.0 mm to 9.0 mm.

20. The heat exchanger according to claim 18, wherein:

the inflow pipe includes a first longitudinal shell and a second longitudinal shell, the first shell and the second shell connected to one another and defining the inflow pipe;

the passage screen has a surrounding outer edge including:

a first contour portion engaging an inner surface of the first shell;

a second contour portion engaging an inner surface of the second shell; and two step portions connecting the first contour portion and the second contour portion; and two opposing ends of the second shell project into the first shell, contact the inner surface of the first shell, and abut a respective step portion of the two step portions of the outer edge of the passage screen.

* * * * *